US007607467B2

(12) United States Patent
McDonald et al.

(10) Patent No.: US 7,607,467 B2
(45) Date of Patent: Oct. 27, 2009

(54) WEB DISPENSER

(75) Inventors: Gregory E. McDonald, Simpsonville, SC (US); Timothy S. Dennison, Greer, SC (US); Glenn W. Killinger, Simpsonville, SC (US); Jeffrey L. Walker, Easley, SC (US)

(73) Assignee: Cryovac, Inc., Duncan, SC (US)

( * ) Notice: Subject to any disclaimer, the term of this patent is extended or adjusted under 35 U.S.C. 154(b) by 458 days.

(21) Appl. No.: 11/333,569

(22) Filed: Jan. 17, 2006

(65) Prior Publication Data

US 2007/0164071 A1 Jul. 19, 2007

(51) Int. Cl.

| | |
|---|---|
| ***B32B 38/04*** | (2006.01) |
| ***B32B 43/00*** | (2006.01) |
| ***B65B 41/10*** | (2006.01) |
| ***B65B 41/16*** | (2006.01) |
| ***B65G 47/46*** | (2006.01) |
| ***B65G 47/10*** | (2006.01) |
| ***B65H 20/02*** | (2006.01) |
| ***B65H 35/10*** | (2006.01) |
| ***B26F 3/02*** | (2006.01) |
| *B29C 65/02* | (2006.01) |

(52) U.S. Cl. ..... 156/510; 53/389.4; 53/504; 198/351; 198/369.2; 226/168; 226/188; 226/190; 225/96; 225/100

(58) Field of Classification Search ..... 156/248, 156/250–252, 277, 353, 384, 327, 510, 513, 156/515, 526, 538; 492/25, 187, 189, 194, 492/199; 53/202, 411, 461, 477, 373.7, 375.9, 53/503, 504, 168, 203, 222, 389.1, 389.4; 493/25, 187, 189, 194, 199; 198/351, 369.2; 226/108, 168, 188, 190; 225/96, 100

See application file for complete search history.

(56) References Cited

U.S. PATENT DOCUMENTS 3,161,347 A 12/1964 Hannon (Continued)

FOREIGN PATENT DOCUMENTS

DE 2 036 004 1/1972

(Continued)

OTHER PUBLICATIONS

International Search Report ( 4 pages) for International Application No. PCT/US2006/048027, dated May 07, 2007.

(Continued)

*Primary Examiner*—Philip C Tucker
*Assistant Examiner*—Sing P Chan
(74) *Attorney, Agent, or Firm*—Mark B. Quatt

(57) ABSTRACT

An apparatus for selectively dispensing a web from a plurality of rolls of serrated bags or layflat tubing comprises a web selector for selecting and advancing a web from the plurality of rolls; a bag driver for advancing the selected web and separating a bag from the web; and a bag transfer device for transporting the separated bag from the bag driver to a location for processing. A sealer/cutter is used to produce a bag from the layflat tubing. A method of selectively dispensing a web from a plurality of rolls of serrated bags or layflat tubing comprises selecting and advancing a web from the plurality of rolls of serrated bags; advancing the selected web and separating a bag from the web; and transporting the separated bag to a location for further processing. In the case of layflat tubing, the selected web is sealed and cut to make a bag.

6 Claims, 14 Drawing Sheets

U.S. PATENT DOCUMENTS

| | | | | | |
|---|---|---|---|---|---|
| 3,270,931 | A | | 9/1966 | Ried et al. | |
| 3,286,005 | A | * | 11/1966 | Cook | 264/563 |
| 3,587,843 | A | | 6/1971 | Wing | |
| 3,701,318 | A | | 10/1972 | Lozeau et al. | |
| 3,724,167 | A | | 4/1973 | Pizmoht | |
| 3,733,128 | A | * | 5/1973 | Naumann et al. | 355/45 |
| 3,837,549 | A | | 9/1974 | Sengewald | |
| 4,120,134 | A | | 10/1978 | Scholle | |
| 4,179,055 | A | | 12/1979 | Milner | |
| 4,341,586 | A | * | 7/1982 | Koutonen | 156/518 |
| 4,505,092 | A | | 3/1985 | Bowers et al. | |
| 4,516,385 | A | | 5/1985 | Lenker et al. | |
| 4,616,472 | A | | 10/1986 | Owensby et al. | |
| 4,825,622 | A | * | 5/1989 | Nigg | 53/203 |
| 5,024,042 | A | | 6/1991 | Meyer | |
| 5,327,704 | A | | 7/1994 | Hoekzema et al. | |
| 5,328,438 | A | | 7/1994 | Crowley | |
| 5,474,208 | A | | 12/1995 | Ball | |
| 5,655,356 | A | | 8/1997 | Ginestra et al. | |
| 5,816,990 | A | | 10/1998 | Melville | |
| 5,979,841 | A | | 11/1999 | Piraneo et al. | |
| 5,987,854 | A | | 11/1999 | Killinger et al. | |
| RE36,759 | E | | 7/2000 | Hoover et al. | |
| 6,267,661 | B1 | | 7/2001 | Melville | |
| 6,663,905 | B1 | | 12/2003 | Ennis et al. | |
| 6,932,751 | B1 | * | 8/2005 | Ward et al. | 493/25 |
| 6,955,029 | B2 | | 10/2005 | Palumbo | |

FOREIGN PATENT DOCUMENTS

| | | | | |
|---|---|---|---|---|
| GB | 1094805 | | | 12/1967 |
| GB | 1094805 | A | * | 12/1967 |
| WO | WO 99/02409 | A1 | | 1/1999 |
| WO | WO 02/30759 | A2 | | 4/2002 |

OTHER PUBLICATIONS

International Preliminary Report on Patentability and Written Opinion of the International Searching Authority (7 pages) for International Application No. PCT/US2006/048027, dated Jul. 31, 2008.

* cited by examiner

WEB DISPENSER

FIELD OF THE INVENTION

The present invention relates to an apparatus and method for selectively dispensing a web from a plurality of rolls of serrated bags or lay-flat tubing.

BACKGROUND OF THE INVENTION

Many packaging applications, especially food packaging, require or benefit from the use of bags made from various thermoplastic materials and structures.

These bags are commonly used in large scale meat processing and/or packaging systems where production speed and efficiency are important. Bags to be used in these systems are often themselves packed in boxes, the individual bags taped together so that they will feed in a predictable and efficient manner to an article loading station. Typical of such technology is U.S. Pat. No. 3,161,347 (Hannon), disclosing a tape to which bags are attached, and U.S. Pat. No. 3,587,843 (Wing), disclosing two tapes to which are attached imbricated (i.e. shingled) bags.

At the loading station of a conventional system, each bag is opened and then loaded with an article such as a fresh red meat subprimal or smoked and processed meat, poultry, cheese, or other perishable food product, or other product.

Alternatively, bags can be provided in a roll, with adjoining bags connected by a transverse line of serrations or perforations.

In some packaging environments, such as the packaging of various cuts of fresh red meat, individual meat cuts can vary significantly in size. If pre-made bags are used to package these individual cuts, it may be necessary to have on hand bags of different dimensions, e.g. width and/or length, to accommodate the variability in product size.

It is desirable to provide an apparatus and method for selectively dispensing a web from a plurality of rolls of serrated bags or lay-flat tubing.

SUMMARY OF THE INVENTION

In a first aspect, an apparatus for selectively dispensing a web from a plurality of rolls of serrated bags, each roll of bags having a series of bags connected by transverse perforations, comprises a web selector adapted to select and advance a web from the plurality of rolls of webs; a bag driver adapted to advance the selected web and separate a bag from the web; and a bag transfer device adapted to transport the separated bag from the bag driver to a location for further processing.

In a second aspect, a method of selectively dispensing a web from a plurality of rolls of serrated bags, each roll of bags having a series of bags connected by transverse perforations, comprises selecting and advancing a web from the plurality of rolls of serrated bags; advancing the selected web and separating a bag from the web; and transporting the separated bag to a location for further processing.

In a third aspect, an apparatus for selectively dispensing a web from a plurality of rolls of layflat tubing comprises a web selector adapted to select and advance a web from the plurality of rolls of layflat tubing; a sealer/cutter for producing a bag from the layflat tubing; a bag driver adapted to advance the selected web and separate the bag from the web; and a bag transfer device adapted to transport the separated bag from the bag driver to a location for further processing.

In a fourth aspect, a method of selectively dispensing a web from a plurality of rolls of layflat tubing comprises selecting and advancing a web from the plurality of rolls of layflat tubing; sealing and cutting the selected web to make a bag; advancing the selected web and separating the bag from the web; and transporting the separated bag to a location for further processing.

BRIEF DESCRIPTION OF THE DRAWINGS

In the drawings presented by way of illustration of the invention.

DETAILED DESCRIPTION OF THE INVENTION

The invention provides an apparatus, method, and system for selectively dispensing and optionally printing a discrete web from multiple sources, and optionally positioning the web at a common location. At this common location, the web can be dispensed to a container, or further processed, e.g. by utilizing a web transfer device to transfer the web to e.g. bag loading equipment.

"Web" herein refers to a leading portion of a roll of serrated bags, a roll of lay flat tubular film, etc. in which the leading portion is advanced to interface with the apparatus of the invention and undergo one or more of the operations disclosed herein. Serrated bags as well as lay flat tubular film are well known in the art. Serrated bags are typically in roll form, with adjacent bags attached by means of a set of perforations running transversely to the bags. These serrations allow each leading bag to be separated from the roll of bags as needed. Serrated bags each include a transverse seal at one end of the bag.

Although the embodiments disclosed herein are directed primarily with respect to serrated bags, those skilled in the art will understand that lay flat tubing can be beneficially used in connection with the present invention.

Figure 1:
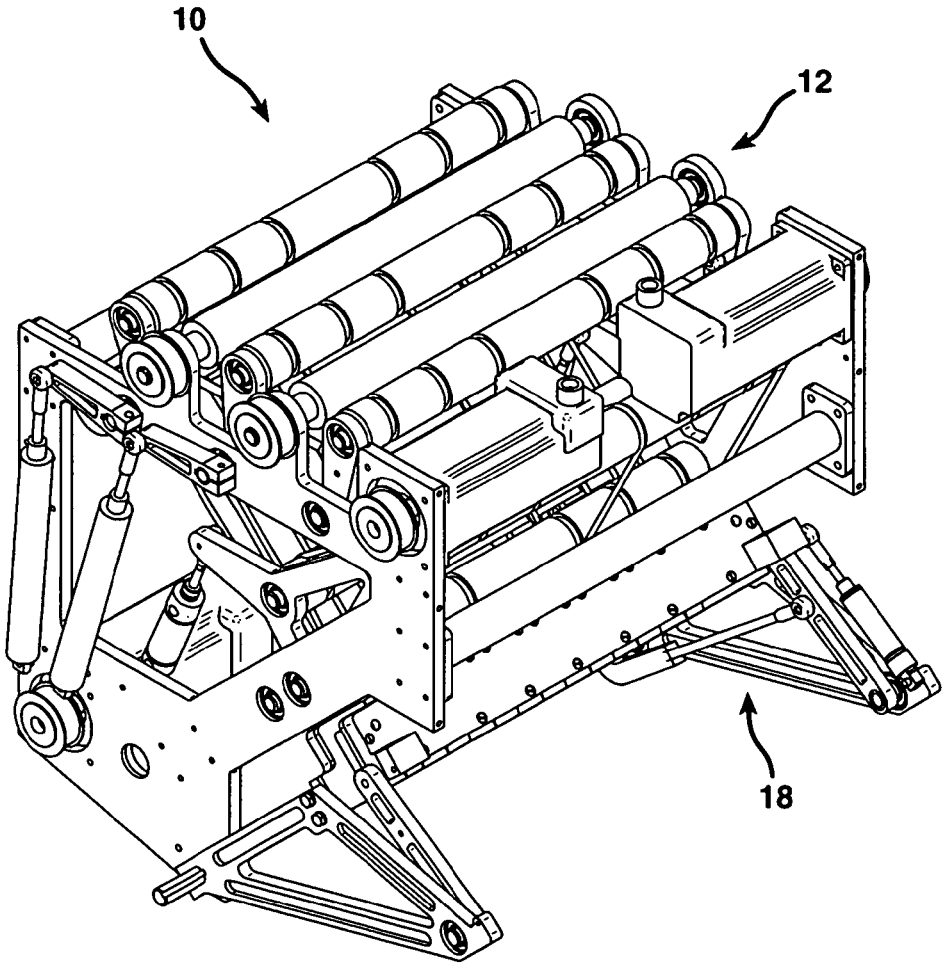
FIG. 1 is a perspective view of an apparatus in accordance with the invention.
Figure 2:
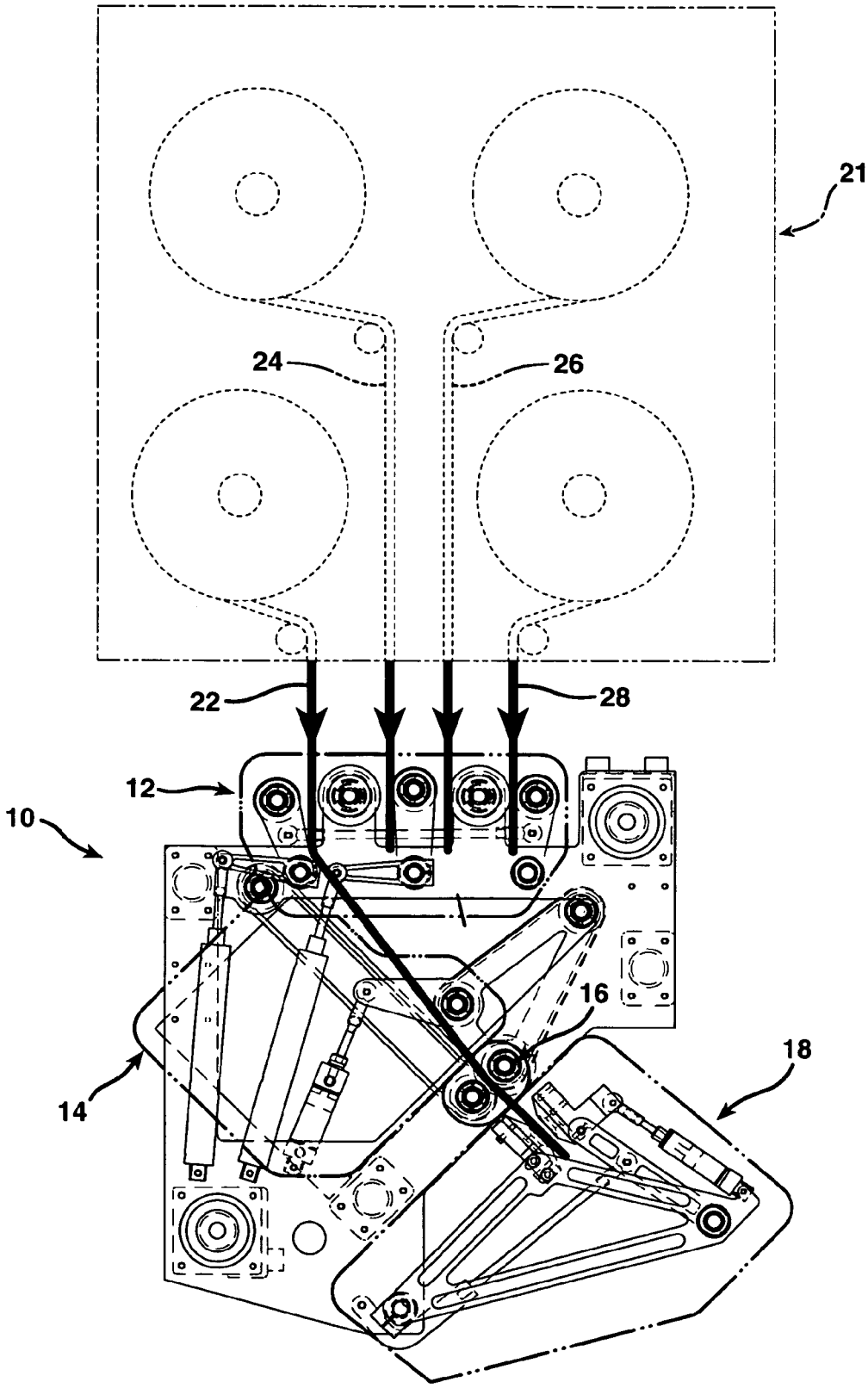
FIG. 2 is a front view of the apparatus of FIG. 1.

FIGS. 1 and 2 disclose an apparatus 10 for selectively dispensing a web from a plurality of rolls of serrated bags, each roll of bags having a series of bags connected by transverse perforations. The apparatus 10 includes a web selector 12, a web printer 14, a web driver 16, and a web transfer device 18.

In one embodiment of the invention, up to four webs of serrated bags [web 22, web 24, web 26 and web 28], each web in the form of a roll of bags, are positioned in the web selector 12, with the free end of each web passing through a respective set of open nips. The open end of the lead bag of each web is at the free end of each respective web. In operation, the nip corresponding to the selected web is closed, and the nip is driven, thus feeding the web through the web printing device 14 (if the web is to be printed) with the free end of the web sequentially captured and driven by the nip of the web driver 16 and (if e.g. the web is to be advanced to a bag loader) positioned for engagement by the web transfer device 18.

Figure 6:
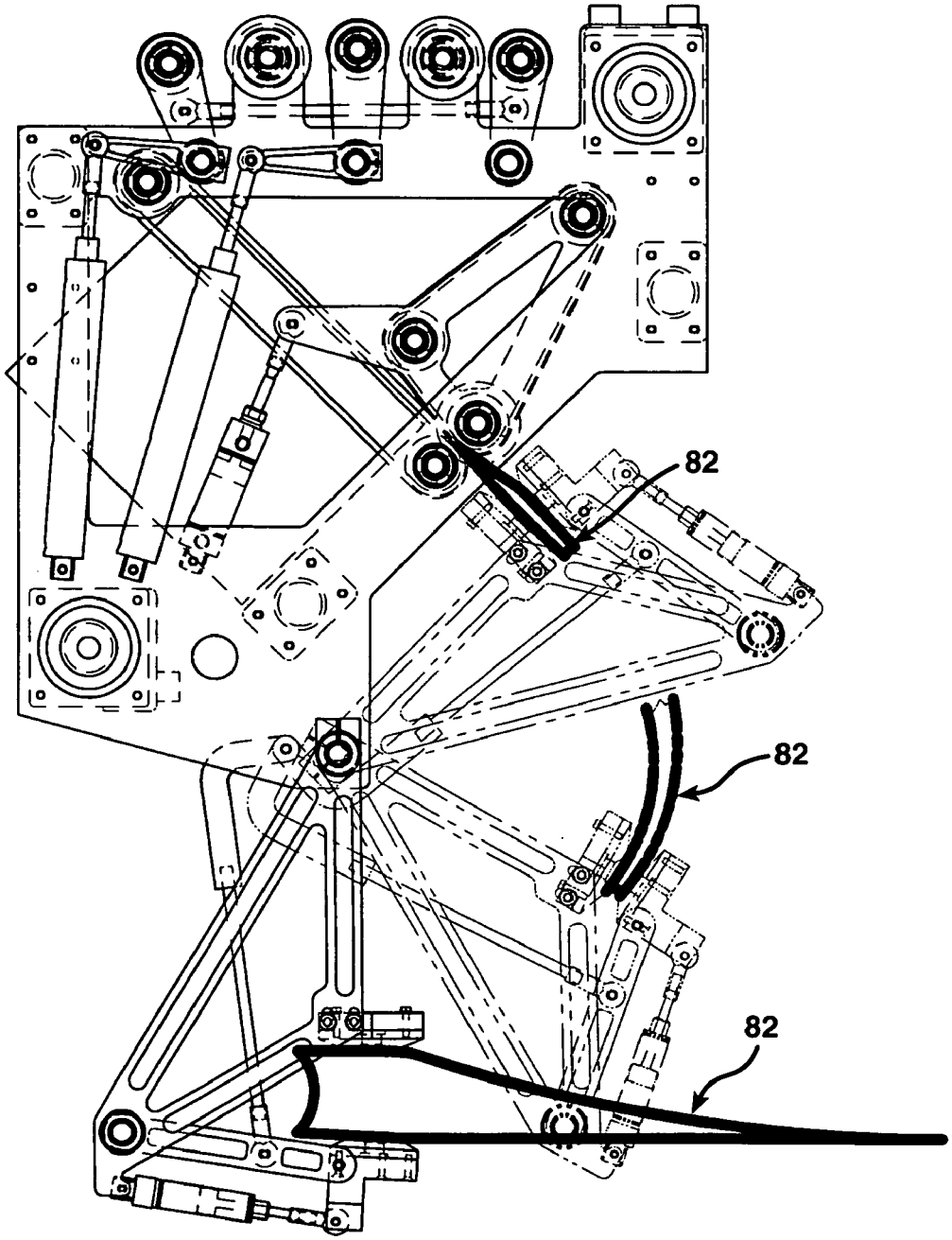
FIG. 6 is a front view of the apparatus of FIG. 2 showing operation of the web transfer device of the apparatus.

Following engagement by the web transfer device 18, the web 22 and web transfer device 18 advance until the serration is positioned at the previous position of the free end of the web. At this time, the nip of the web selector 12 stops, separating the web at the serration because of the tension applied by the continued feeding of the web driver 16. Following separation, the nip of web transfer device 18 continues to run until the bag tail (the upstream or trailing end of the bag) is cleared. During web advancement, the web driver 16 advances the web 22 at a slightly greater rate than the web transfer device 18 to insure that the web 22 is not pulled free of the web transfer device 18. In embodiments where the web 22 is to be printed, the web is passed through web printer 14, and the web is printed with indicia such as a trademark (word and/or logo), information related to the ultimate contents of the bag to be formed from web 22, etc. Web printer 14 can be of any suitable type, such as e.g. a thermal transfer printer. Alternatively, by employing an intermittent printer (i.e. a printer that is operated in an intermittent or discontinuous manner) the print may be applied during the dwell following presentation of the web to and engagement of the web with the web transfer device 18. The web transfer device 18 opens the bag mouth while traveling to the handoff position as shown in FIG. 6.

Figure 3:
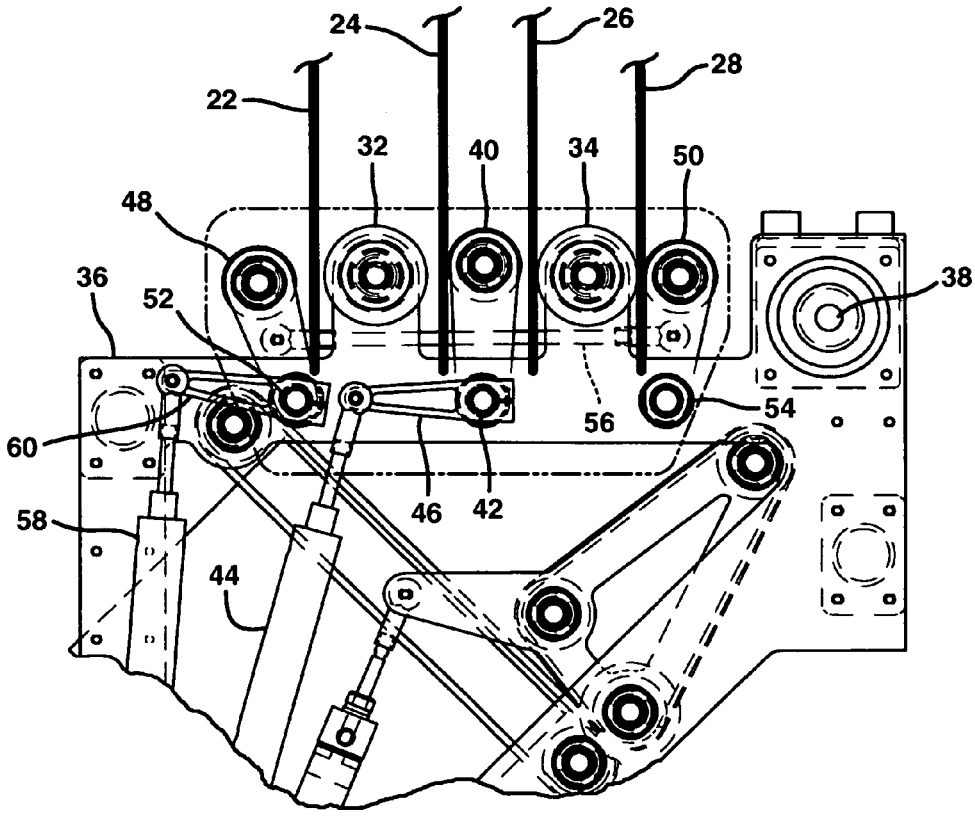
FIG. 3 is an enlarged view of a web selection device of the apparatus of FIG. 2.

FIG. 3 illustrates the web selector 12 in more detail. Stationary drive rolls 32 and 34 are attached to side plate 36. Drive rolls 32 and 34 are driven through a common reversible drive 38. The center moveable roll assembly 40 can pivot about pivot shaft 42, which resides in one of three positions determined by the three-position pneumatic actuator 44 acting through link 46.

The three positions of the center moveable roll assembly 40 result in three possible settings, namely:

1. web 24 nipped to drive roll 32. This setting is achieved by actuation of pneumatic actuator 44 to cause link 12 to rotate in a counterclockwise direction. This in turn causes pivot shaft 42 to rotate in a counterclockwise direction such that center moveable roll assembly 40 pivots to the left (as viewed in FIG. 3), pinching web 24 between center moveable roll assembly 40 and stationary drive roll 32.
2. web 26 nipped to drive roll 34. This setting is achieved by actuation of pneumatic actuator 44 to cause link 12 to rotate in a clockwise direction. This in turn causes pivot shaft 42 to rotate in a clockwise direction such that center moveable roll assembly 40 pivots to the right (as viewed in FIG. 3), pinching web 26 between center moveable roll assembly 40 and stationary drive roll 34.
3. neither web 24 or 26 nipped, with the center moveable roll assembly 40 positioned in the neutral position shown, i.e. disengaged from drive rolls 32 and 34.

Thus, in one embodiment, the web selector 12 includes a first and second stationary drive roll spaced apart from one another; a central moveable roll disposed between and spaced apart from the first and second stationary drive rolls; and a mechanism for selectively moving the center moveable roll toward the first and second stationary drive rolls respectively; the center moveable roll and the first stationary drive roll adapted to accommodate a first web disposed between the center moveable roll and the first stationary drive roll, and to selectively nip the first web between the center moveable roll and the first stationary drive roll; and the center moveable roll and the second stationary drive roll adapted to accommodate a second web disposed between the center moveable roll and the second stationary drive roll, and to selectively nip the web between the center moveable roll and the second stationary drive roll. In this embodiment, two webs can be employed. These webs can be identical, but beneficially are different in some way. The difference can be a dimensional difference, such as width, length, or both; a compositional difference, such as the composition, thickness, or construction of each web; or any other difference that could be of benefit to a processor or packager.

In another embodiment, outer moveable roll assemblies 48 and 50 can pivot around pivot shafts 52 and 54 respectively. The moveable roll assemblies 48 and 50 are coupled by connecting link 56, and actuated with the three-position pneumatic actuator 58 acting through link 60, producing three conditions, namely:

1. web 22 nipped to drive roll 32. This setting is achieved by actuation of pneumatic actuator 58 to cause link 60 to rotate in a clockwise direction. This in turn causes moveable roll assembly 48 to rotate in a clockwise direction such that moveable roll assembly 48 pivots to the right (as viewed in FIG. 3), pinching web 22 between moveable roll assembly 48 and stationary drive roll 32.
2. web 28 nipped to drive roll 34. This setting is achieved by actuation of pneumatic actuator 58 to cause link 60 to rotate in a counterclockwise direction. This in turn causes moveable roll assembly 50 (by means of its connection, via connecting link 56, with moveable roll assembly 48) to rotate in a counterclockwise direction such that moveable roll assembly 50 pivots to the left (as viewed in FIG. 3), pinching web 28 between moveable roll assembly 50 and stationary drive roll 34.
3. neither web 22 or 28 nipped, with the outer moveable roll assemblies 48 and 50 positioned in the neutral position shown, i.e. disengaged from drive rolls 32 and 34.

Thus, in this embodiment, four webs can be accommodated in a web selector.

In an alternative embodiment, an apparatus like those just described can be provided, in which a center stationary drive roll is positioned between, and spaced apart from, a first and second moveable roll assembly. A web can be accommodated in the space between the single stationary drive roll, and the first moveable roll assembly, and between the single stationary drive roll, and the second moveable roll assembly. The first and second moveable roll assemblies can be coupled by a connecting link, and actuated with a three-position pneumatic actuator acting through a link, producing three conditions like those described above. Alternatively, each of the first and second moveable roll assemblies can be separately actuated with its own three-position pneumatic actuator, without the need for a connecting link that couples the first and second moveable roll assemblies.

Thus, in this embodiment, two webs can be accommodated in a web selector.

To advance a specified web the required nip is closed and drive motor 38 is activated in the proper direction. Positions of the moveable roll assemblies are controlled in a manner to ensure only one web is nipped at any given time.

Figure 4:
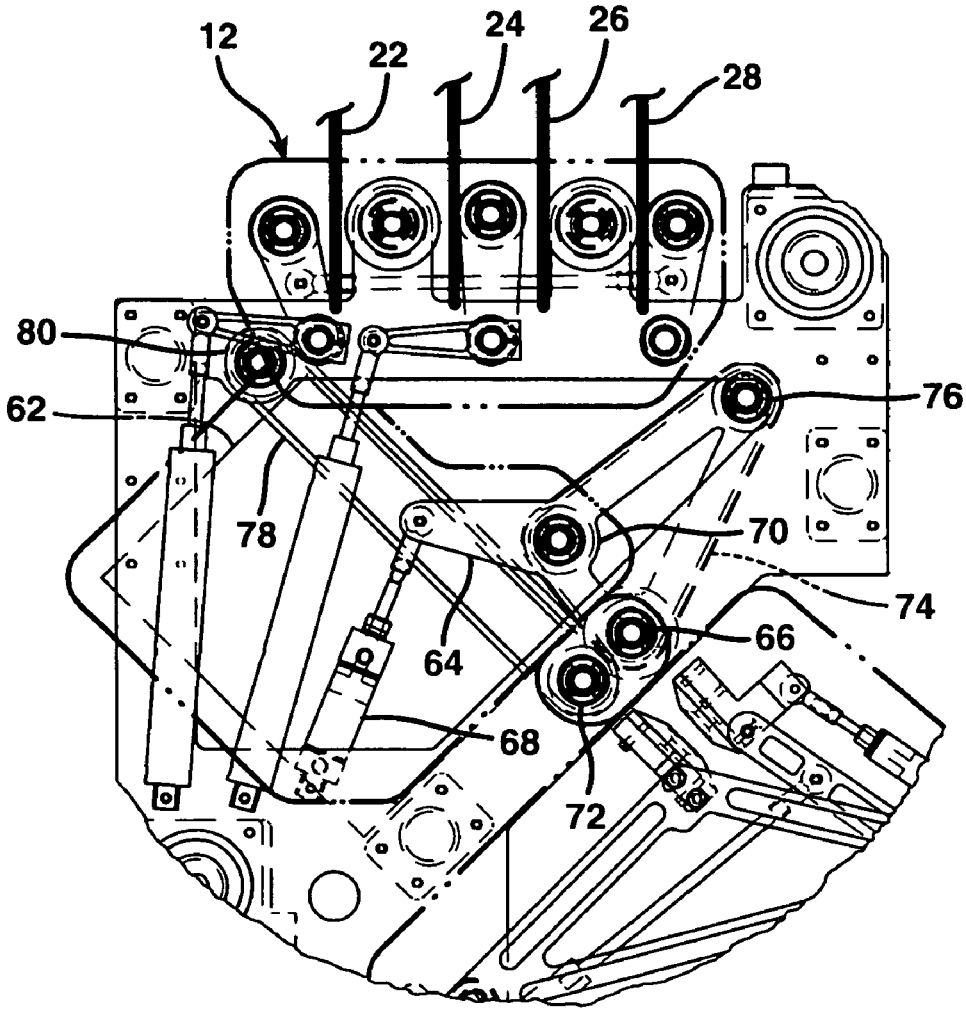
FIG. 4 is an enlarged view of a web driver of the apparatus of FIG. 2.

Referring to FIG. 4 the web printing device 14 includes a printer 62, and an anvil roll assembly including an anvil roll frame 64 that pivots around drive roll 66. Actuator 68 opens the anvil roll 70 providing clearance for the free end of the web. After the free end of the web passes, the anvil roll 70 closes, positioning the web 22 for printing. The anvil roll assembly guides the web 22 from the web selector 12 to the web printing device 14. The web driver 16 includes drive rolls 66 and 72 driven by a drive motor [not shown]. Guiding the web 22 from the web selector 12 to the web printing device 14 are belts 74 with idler roll 76 and belts 78 with idler roll 80. During operation, the web driver 16 can present e.g. between 2 and 3 inches of a web segment 82 to the web transfer device 18 as shown in FIG. 6.

Figure 5:
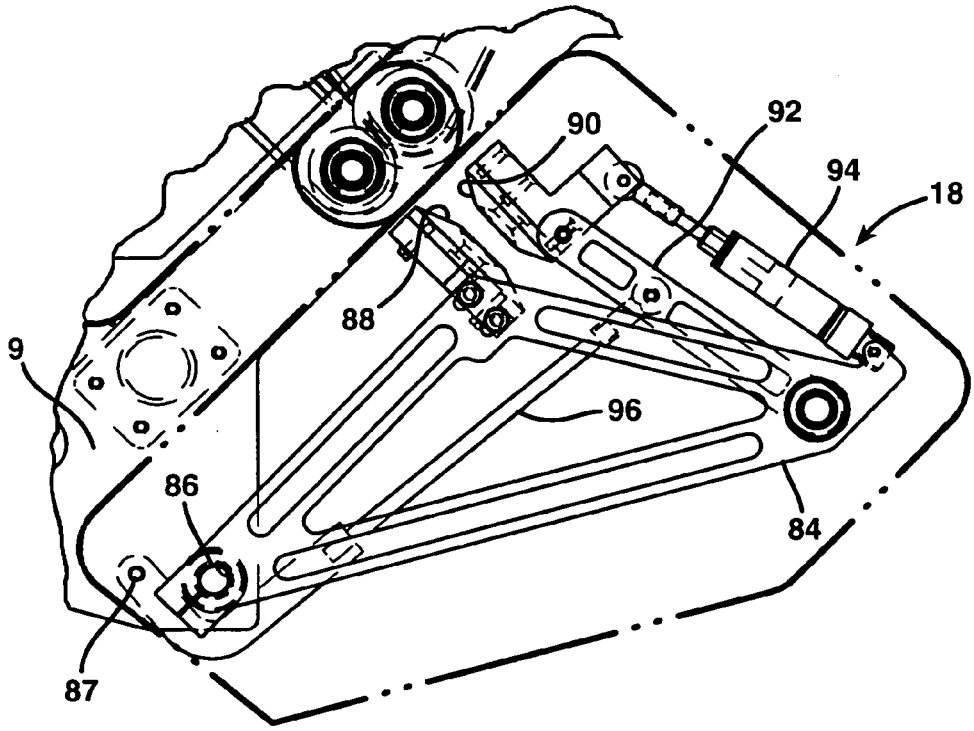
FIG. 5 is an enlarged view of a web transfer device of the apparatus of FIG. 2.

As shown in FIG. 5, the web transfer device 18 includes a web transfer frame 84 that pivots around pivot shaft 86, a stationary vacuum bar 88 (i.e. stationary relative to the web transfer frame 84), positioned opposite a movable vacuum bar 90. The movable vacuum bar 90 is connected to the web transfer frame 84 with link 92 and actuator 94 that maintain its orientation to the stationary vacuum bar 88. The gap between vacuum bars 88 and 90 is controlled by link 96 and actuator 94. The actuator 94 is used to open or close the vacuum bars 88 and 90 at the web drive device 16 as required. As the bag transfer frame 84 rotates, attachment of link 96 to side plate 9 at pivot point 87 results in an additional opening motion of the vacuum bar 90 independent of the action of actuator 94. The bag opening sequence is shown in FIG. 6.

Figure 7:
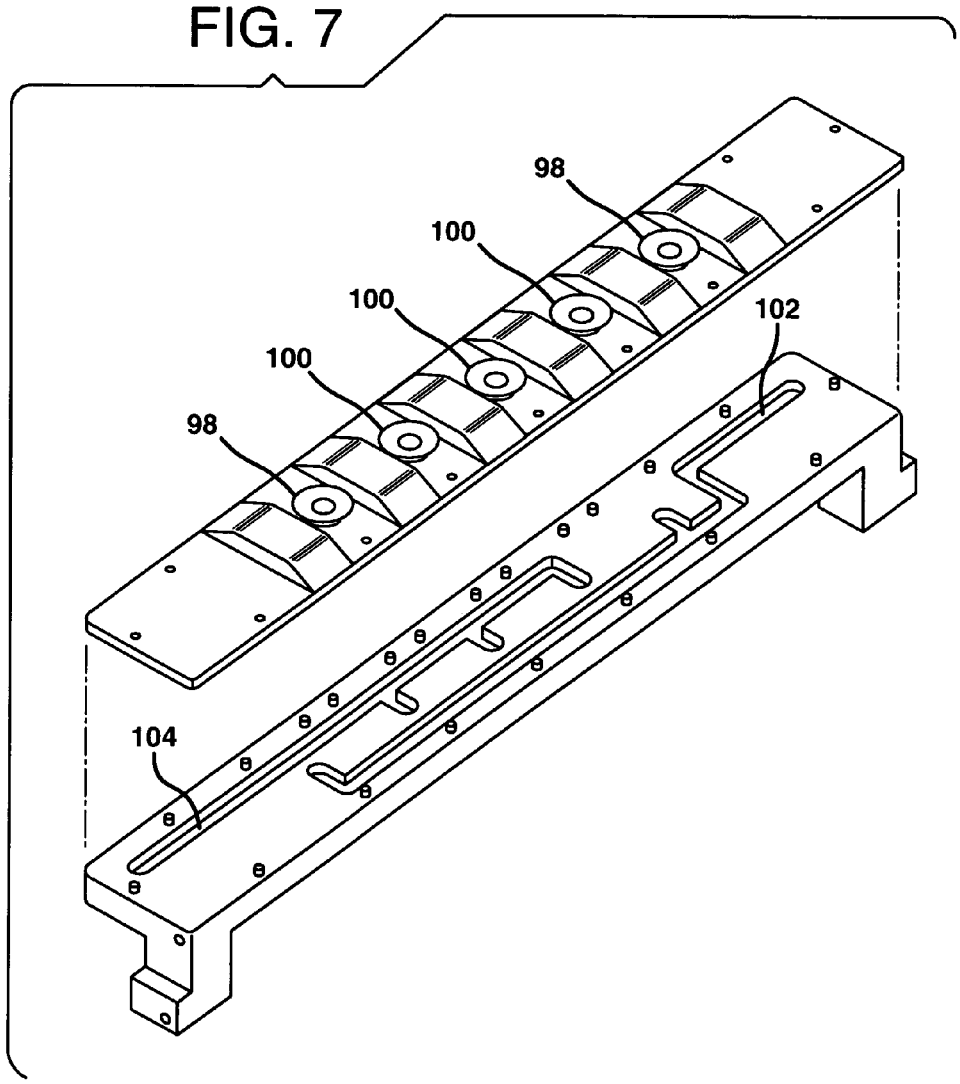
FIG. 7 is a perspective exploded view of a part of the web transfer device of the apparatus of FIG. 2.

The exploded view of movable vacuum bar 90 in FIG. 7 shows that the outer vacuum cups 98 and inner vacuum cups 100 are in one embodiment connected to separate independently controlled vacuum channels 102 and 104. A common channel can alternatively be utilized, but the potential exists for the outer vacuum cups 98 to not be covered for narrow web widths, thus decreasing the vacuum and reducing the holding efficiency of the remaining covered vacuum cups.

In the operation of the present invention, in embodiments where rolls of serrated bags are employed, it is beneficial to provide a way of dispensing each bag an appropriate distance as it feeds from the selected roll.

One way of accomplishing this is the use of printed registration marks. The use of printed registration marks is generally well known in the web handling and packaging arts.

One disadvantage of using printed registration marks is that an additional operation is required in manufacturing the roll of serrated bags. The printed registration marks must be printed in sequential fashion on each of the series of bags. This adds cost to the roll of bags.

Figure 8:
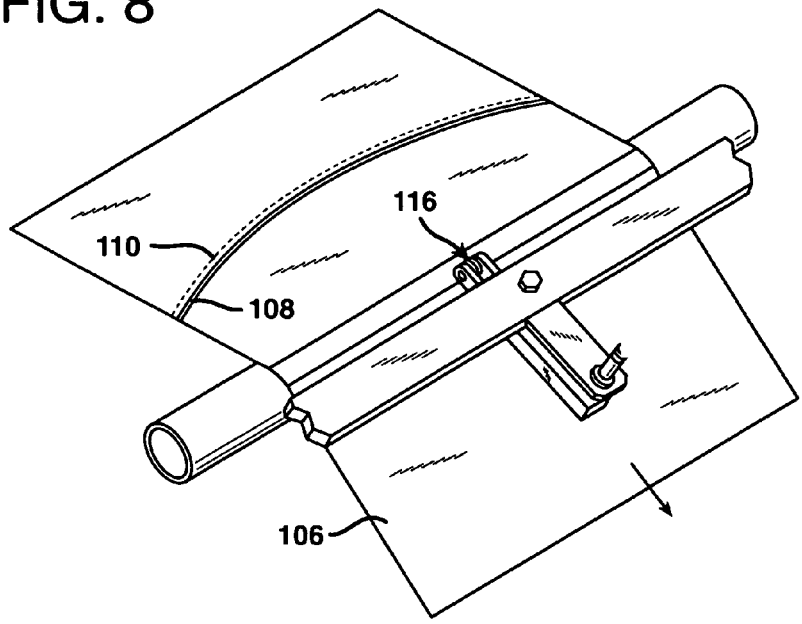
FIG. 8 is a perspective view of a device for registering roll serrated bags, for use in connection with the present invention.
Figure 9:
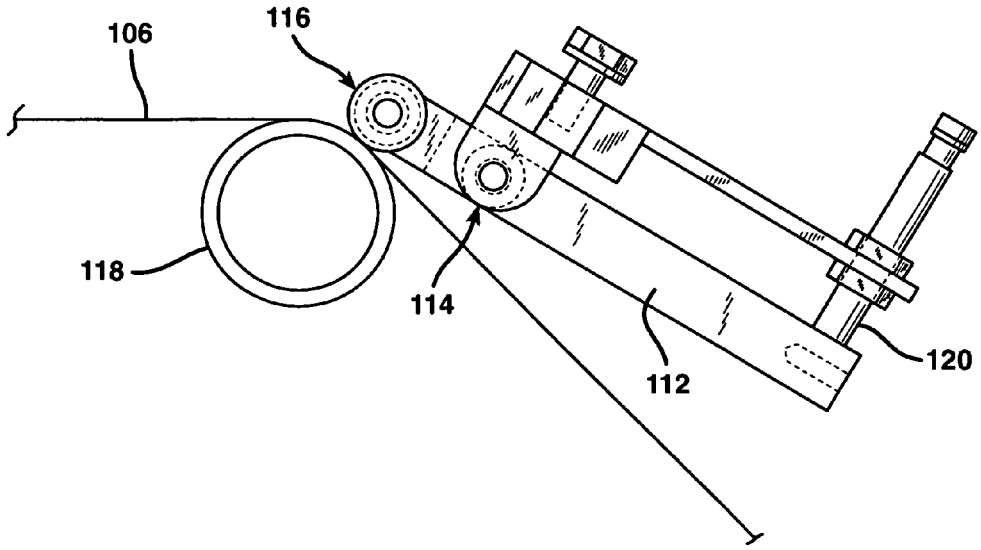
FIG. 9 is a front view of the device of FIG. 8.
Figure 10:
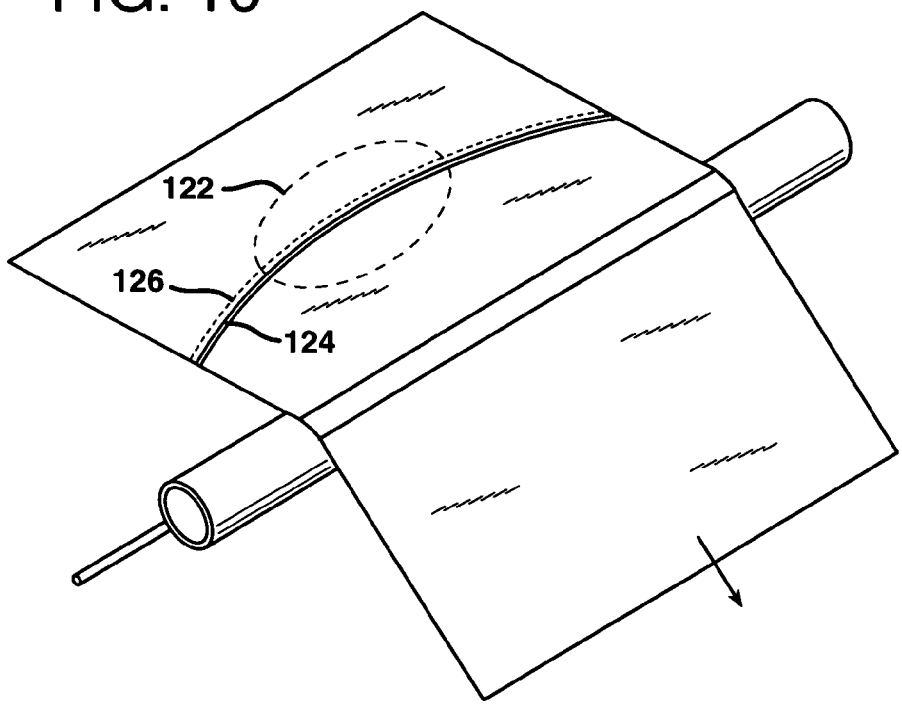
FIG. 10 is a perspective view of an alternative device for registering roll serrated bags in accordance with the present invention.

In another embodiment, and referring to FIGS. 8 and 9, each bag 106 in a roll of serrated bags includes a seal 108, which can be rectilinear or curved, and a serration 110 adjacent seal 108. Seal 108 is a different thickness than the unsealed film around it. As shown in the drawings, the machine direction, i.e. the path of travel of the bags, is such that the seal 108 precedes the serration 110; that is, the seal is positioned downstream of the serration. Alternatively, the serration 110 can precede the seal 108. Bag registration for further machine processes, such as printing, and/or separation of a bag from the next sequential bag in the series of bags, can be accomplished by sensing the rotary displacement of lever arm 112 around pivot point 114 due to the action of seal 108 displacing roller 116 away from fixed member 118. Sensing the motion of lever arm 112 is done by proximity switch 120, or other suitable motion detection device. A registration signal is thus generated as each seal passes a fixed point.

In another embodiment, and referring to FIGS. 10 to 13, each bag 122 in a roll of serrated bags includes a seal 124, which can be straight or curved, and a serration 126 adjacent seal 124. As shown in the drawings, the machine direction, i.e. the path of travel of the bags, is such that the seal 124 precedes the serration 126; that is, the seal is positioned downstream of the serration. Alternatively, the serration 126 can precede the seal 124.

Figure 11:
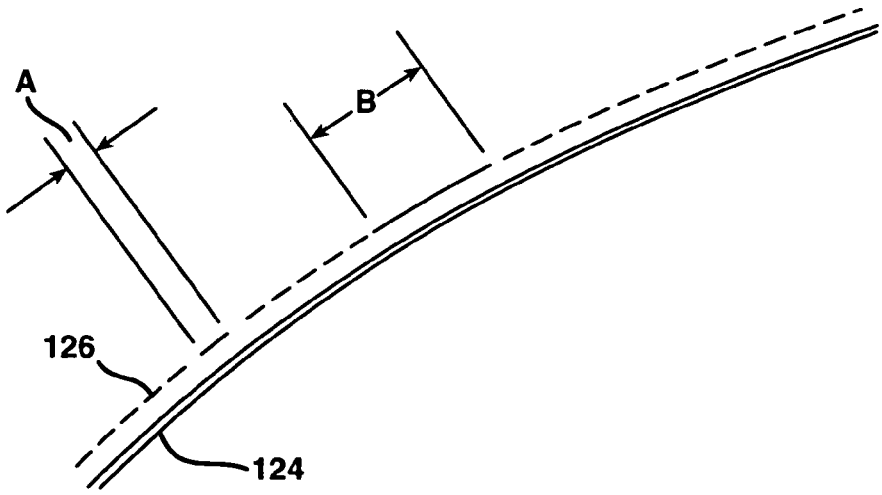
FIG. 11 is a perspective enlarged view of the encircled portion of FIG. 10.
Figure 12:
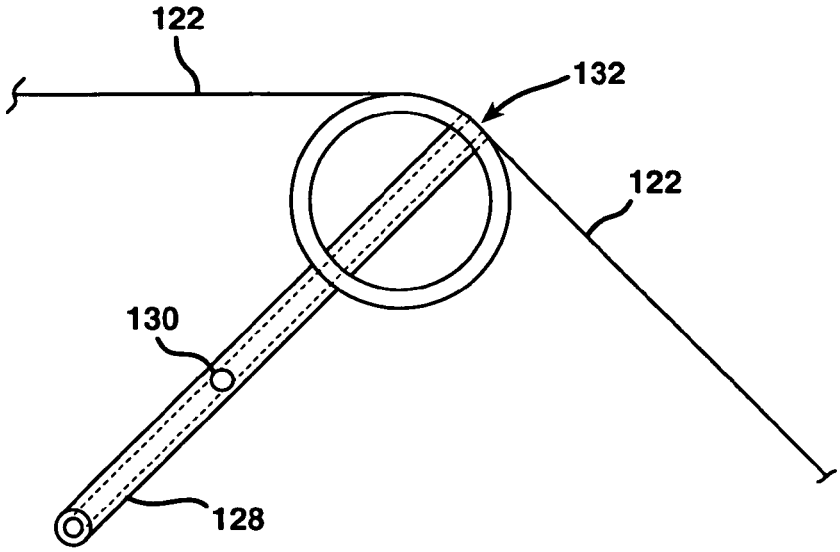
FIG. 12 is a front view of the device of FIG. 10.
Figure 14:
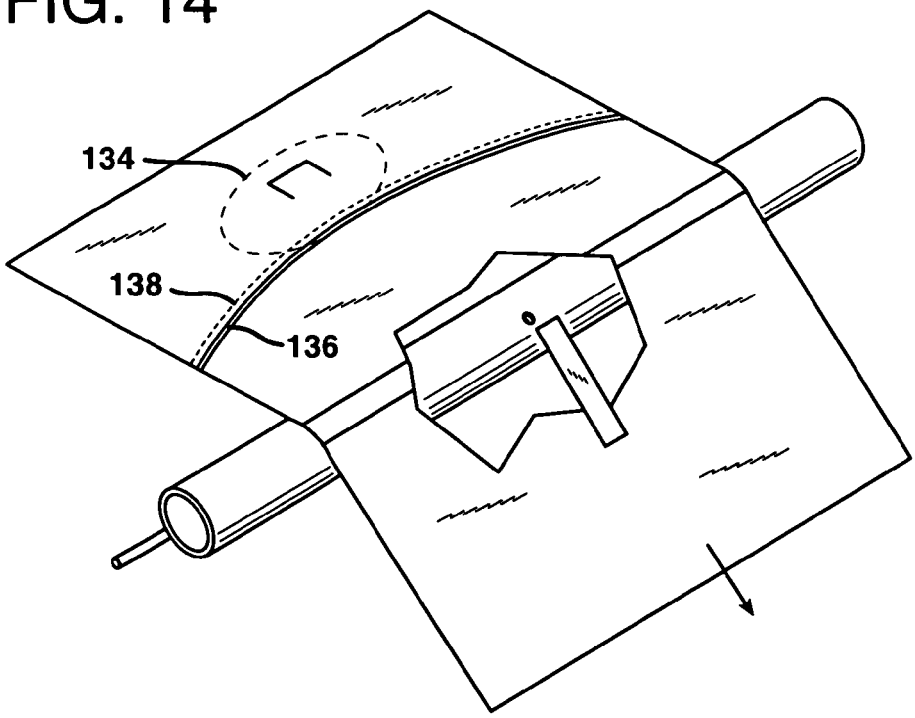
FIG. 14 is a perspective view of another alternative device for registering roll serrated bags in accordance with the present invention.
Figure 13:
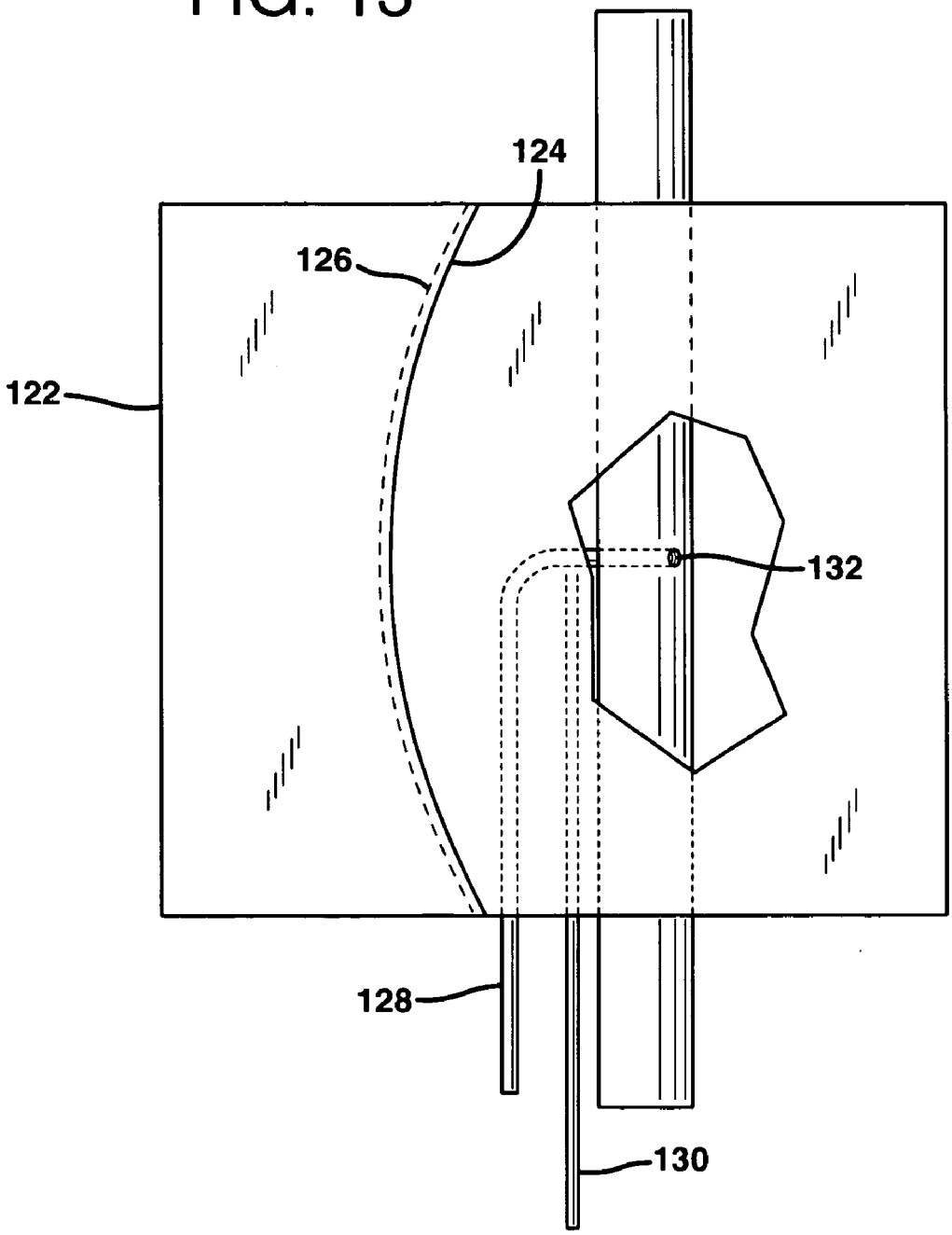
FIG. 13 is a plan view of the device of FIG. 10.

As shown in FIG. 11, serration 126 is constructed with alternated holes and bridges with dimensions of e.g. 0.25 inches for A and 1.0 inches for B. Any suitable dimensions and distribution of holes and bridges can be employed. Bag registration for further machine processes, such as printing, and/or separation of a bag from the next sequential bag in the series of bags, can be accomplished by sensing the drop in air pressure in air line 128 by means of sensing port 130 as the elongated hole portion of serration 126 passes over the exit end 132 of air line 128. A registration signal is thus generated as the serration 126 of each sequential bag passes a fixed point.

The embodiment of FIGS. 10 to 13 can be beneficially used with a variety of bag types, including patch bags, and bags without patches. An additional advantage of this embodiment is that the elongated hole portion of the serration 126 provides an opening for the release of trapped air during winding in the manufacturing process.

In yet another embodiment, and referring to FIGS. 14 to 18, each bag 134 in a roll of serrated bags includes a seal 136, which can be straight or curved, and a serration 138 adjacent seal 136. As shown in the drawings, the machine direction, i.e. the path of travel of the bags, is such that the seal 136 precedes the serration 138; that is, the seal is positioned downstream of the serration. Alternatively, the serration 138 can precede the seal 136.

Figure 15:
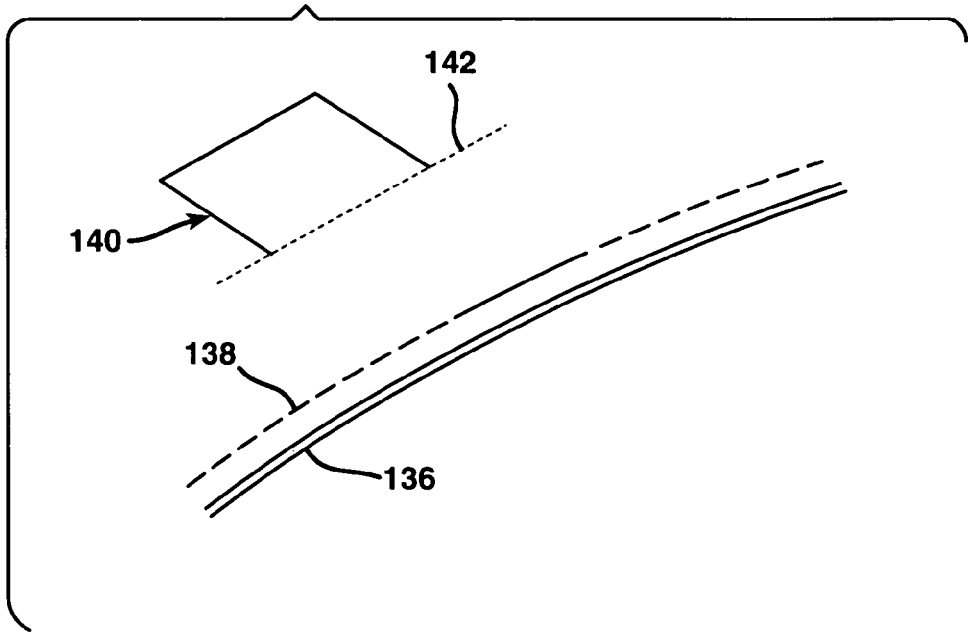
FIG. 15 is a perspective enlarged view of the encircled portion of FIG. 14.
Figure 16:
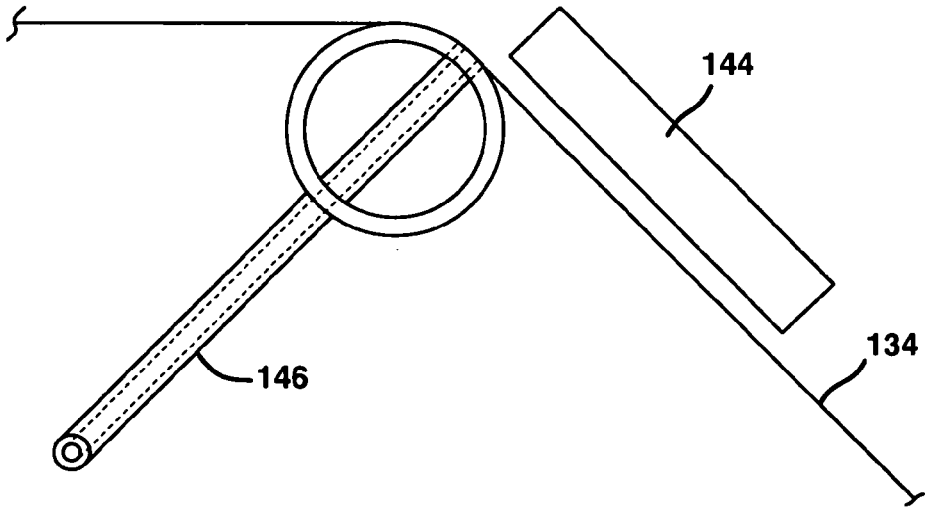
FIG. 16 is a front view of the device of FIG. 14.
Figure 17:
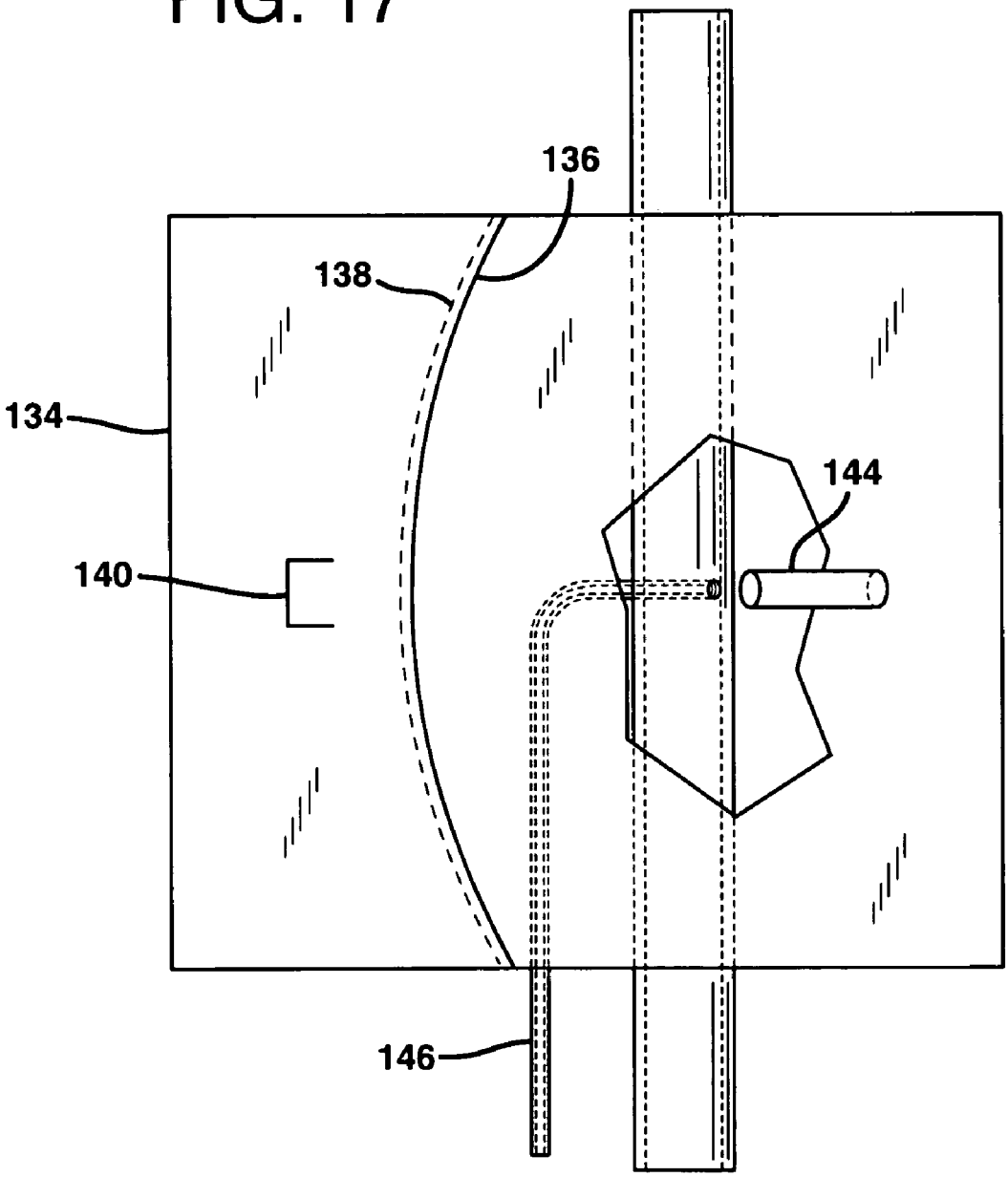
FIG. 17 is a plan view of the device of FIG. 14.
Figure 18:
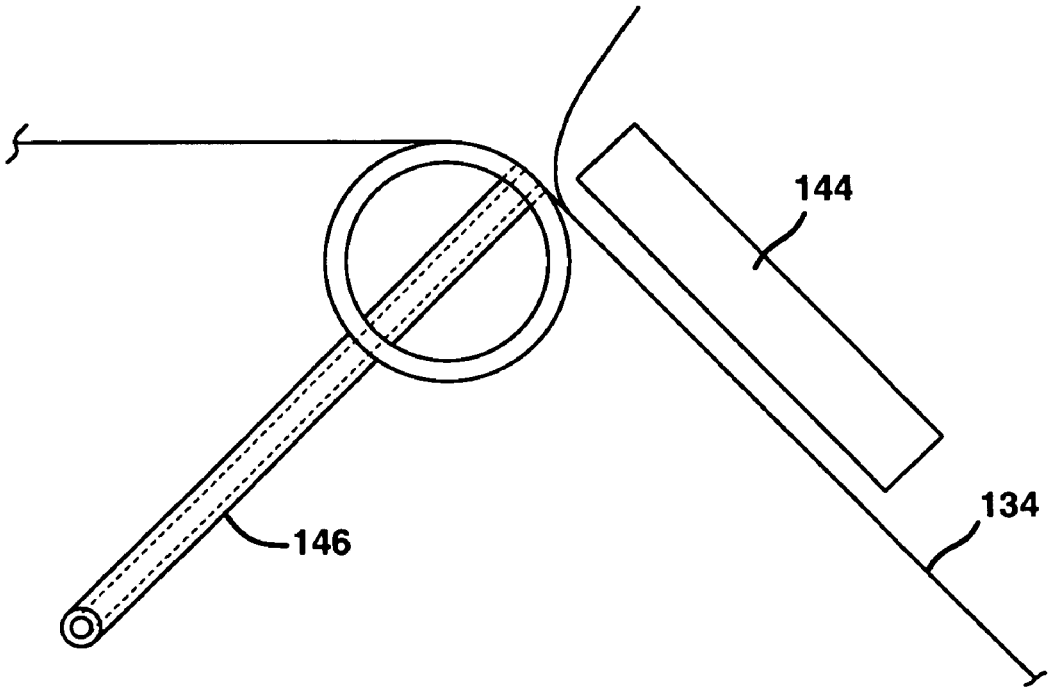
FIG. 18 is a side view of the device of FIG. 14 after a tab has reached the proximity switch of the invention.

As shown in FIG. 15, bag 134 is constructed with a through cut that forms a tab 140, which hinges around reference line 142. Although the tab 140 and reference line 142 are shown as rectangular, any suitable geometry can be employed. Bag registration for further machine processes, such as printing, and/or separation of a bag from the next sequential bag in the series of bags, can be accomplished by sensing the tab 140 with proximity switch 144 as the tab passes over the exit end of air line 146. A registration signal is thus generated. The tab 140 is sensed because the air pressure from air line 146 forces the tab above the plane of the bag 134, where the tab can be sensed by the proximity switch 144.

In another embodiment, the bag 134 can be used instead of the elongated hole portion of serration 126. Thus, as the tab 140 passes over the exit end 132, a drop in air pressure can be observed at 128.

The embodiment of FIGS. 14 to 18 can be beneficially used with a variety of bag types, including patch bags, and bags without patches. An additional advantage of this embodiment is that the through cut that forms the tab 140 provides an opening for the release of trapped air during winding in the manufacturing process.

In alternative embodiments of the present invention:

An ink jet printer may be used as an alternative to the thermal transfer printer discussed above. The printer can be activated as the web advances, or alternatively can traverse in the web cross direction during a dwell.

A seal bar can be incorporated below the web selector 12 with an intermediate knife system. This would be useful where the web is in the form of a lay flat tube.

A seal bar can be incorporated above the web selector 12 with an intermediate knife system. This would be useful where the web is in the form of a lay flat tube.

The web transfer device can be eliminated, resulting in a manual system.

The invention is described with the web dispenser selectively drawing webs from an overhead bank of rolls of webs, and with the stationary and pivoting drive rolls arranged in a horizontal position. Likewise, the final bag position is shown as being horizontal. By modifying or rearranging one or more components of the invention, the rolls of webs, the web dispenser, and the other components of the invention can be arranged in any suitable orientation or configuration, and any final bag orientation is obtainable.

Major motion of the bag transfer device is rotational. Combining with a linear component results in a greater degree of flexibility benefiting applications such as transferring the bag to a stuffing horn.

The invention provides a practical resolution to the problem of how to select from multiple sources, optionally print, and stage discrete bags.

Problem resolution is achieved in a compact module. Utilizing roll-serrated bags the location of the web free ends are initially held in close proximity thus selection and movement through the print station require very little space.

The invention uses in one embodiment roll serrated bags that typically have less seal pucker and wrinkles as opposed to taped bags. This characteristic presents a more uniform surface for applying print.

The invention uses roll serrated bags, a more compact format than taped bags. Typically diameters of rolls of serrated bags are about 30% less than roll taped bags.

The invention controls web tension during printing.

The invention is capable of printing either side of the bag.

Any films, especially thermoplastic films such as olefinic films with or without oxygen barrier functionality, can be used with benefit in this invention. These films are made by extrusion coating, coextrusion, lamination, or other suitable processes. Especially preferred for many applications are films comprising an outer layer, an intermediate layer, and an inner layer. The materials of the outer layer are often chosen for abuse resistance and/or sealability, and can be chosen from any suitable polymeric materials such as polyolefins, especially ethylenic polymers and copolymers, polypropylene, polyesters, polyamides, and the like. The inner layer materials, often chosen for sealability, can be any of the materials described for the outer layer. The intermediate layer materials are often chosen for their barrier qualities (i.e. barriers to oxygen, moisture, carbon dioxide, etc.). Preferred materials include polyvinylidene chloride polymers and copolymers, ethylene vinyl alcohol copolymer, polyvinyl alcohol, polyamide, polyester, acrylonitrile, and the like. Bags are preferably heat shrinkable, and preferably at least partially crosslinked.

It is to be understood that variations of the present invention can be made without departing from the scope of the invention, which is not limited to the specific embodiments and examples disclosed herein, but extends to the claims presented below.

For example, although the center moveable roll is described herein as a roll that moves to left or right on a pivot point, those skilled in the art will appreciate that any motive device can be used to bring the center moveable roll into contact with a web and nip the web against a stationary roller. An example would be a pneumatic or hydraulic piston, a gear system, or an electro-mechanical actuator.

What is claimed is:

1. An apparatus for selectively dispensing a web of serrated bags from a plurality of rolls of serrated bags, each roll of bags having a series of bags connected by transverse perforations, the apparatus comprising:

a) a web selector adapted to select and advance a web of serrated bags from the plurality of rolls of serrated bags;

b) a bag driver adapted to advance the selected web of serrated bags and separate a first bag from an adjacent second bag along a serration connecting the first and second bags; and c) a bag transfer device adapted to transport the separated first bag from the bag driver to a location for further processing;

wherein the web selector comprises either:

i) a first and second stationary drive roll spaced apart from one another; a center moveable roll substantially horizontally disposed between and spaced apart from the first and second stationary drive rolls; and a mechanism for selectively moving the center moveable roll toward the first and second stationary drive rolls respectively, where the center moveable roll and the first stationary drive roll are adapted to accommodate a first web of serrated bags disposed between the center moveable roll and the first stationary drive roll, and to selectively nip the first web of serrated bags between the center moveable roll and the first stationary drive roll; and where the center moveable roll and the second stationary drive roll are adapted to accommodate a second web of serrated bags disposed between the center moveable roll and the second stationary drive roll, and to selectively nip the second web of serrated bags between the center moveable roll and the second stationary drive roll; or ii) a first and second moveable roll spaced apart from one another; a center stationary drive roll substantially horizontally disposed between and spaced apart from the first and second moveable rolls; and a mechanism for selectively moving the first and second moveable rolls respectively toward the center stationary drive roll, where the center stationary drive roll and the first moveable roll are adapted to accommodate a first web of serrated bags disposed between the center stationary drive roll and the first moveable roll, and to selectively nip the first web of serrated bags between the center stationary drive roll and the first moveable roll, and where the center stationary drive roll and the second moveable roll are adapted to accommodate a second web of serrated bags disposed between the center stationary drive roll and the second moveable roll, and to selectively nip the second web of serrated bags between the center stationary drive roll and the second moveable roll.

2. The apparatus of claim 1 comprising a bag printer.

3. The apparatus of claim 2 comprising a sensor.

4. An apparatus for selectively dispensing a web of serrated bags from a plurality of rolls of serrated bags, each roll of bags having a series of bags connected by transverse perforations, the apparatus comprising a web selector adapted to select and advance a web of serrated bags from the plurality of rolls of serrated bags; a bag driver adapted to advance the selected web of serrated bags and separate a first bag from an adjacent second bag along a serration connecting the first and second bags; and a bag transfer device adapted to transport the separated first bag from the bag driver to a location for further processing;

wherein the web selector comprises:

a) a first and second stationary drive roll spaced apart from one another;

b) a center moveable roll disposed between and spaced apart from the first and second stationary drive rolls; and c) a mechanism for selectively moving the center moveable roll toward the first and second stationary drive rolls respectively;

d) a first outer moveable roll spaced apart from the first stationary drive roll; and e) a second outer moveable roll spaced apart from the second stationary drive roll;

f) a mechanism for selectively moving the first outer moveable roll toward the first stationary drive roll; and g) a mechanism for selectively moving the second outer moveable roll toward the second stationary drive roll;

wherein the center moveable roll and the first stationary drive roll are adapted to accommodate a first web of serrated bags disposed between the center moveable roll and the first stationary drive roll, and to selectively nip the first web of serrated bags between the center moveable roll and the first stationary drive roll;

the center moveable roll and the second stationary drive roll are adapted to accommodate a second web of serrated bags disposed between the center moveable roll and the second stationary drive roll, and to selectively nip the second web of serrated bags between the center moveable roll and the second stationary drive roll;

the first outer moveable roll and the first stationary drive roll are adapted to accommodate a third web of serrated bags disposed between the first outer moveable roll and the first stationary drive roll, and to selectively nip the third web of serrated bags between the first outer moveable roll and the first stationary drive roll; and the second outer moveable roll and the second stationary drive roll are adapted to accommodate a fourth web of serrated bags disposed between the second outer moveable roll and the second stationary drive roll, and to selectively nip the fourth web of serrated bags between the second outer moveable roll and the second stationary drive roll.

5. The apparatus of claim 4 comprising a bag printer.

6. The apparatus of claim 5 comprising a sensor.

* * * * *